United States Patent [19]

Erbor et al.

[11] 4,167,801

[45] Sep. 18, 1979

[54] SUCTION CLEANER POWER NOZZLE CONSTRUCTION

[75] Inventors: Stanley E. Erbor, Cleveland Heights; John P. Kirschensteiner, Euclid, both of Ohio

[73] Assignee: Royal Appliance Manufacturing Company, Highland Heights, Ohio

[21] Appl. No.: 880,754

[22] Filed: Feb. 24, 1978

[51] Int. Cl.[2] ..... A47L 5/34

[52] U.S. Cl. ..... 15/354; 15/377; 15/391

[58] Field of Search ..... 15/354, 377, 391, 416

[56] References Cited

U.S. PATENT DOCUMENTS

| | | | |
|---|---|---|---|
| 1,428,734 | 9/1922 | Wise et al. | 15/354 X |
| 2,348,861 | 5/1944 | Smellie | 15/377 X |
| 3,942,216 | 3/1976 | Minton | 15/416 X |
| 4,023,234 | 5/1977 | Martinec et al. | 15/416 X |

*Primary Examiner*—Christopher K. Moore
*Attorney, Agent, or Firm*—Frease & Bishop

[57] ABSTRACT

A suction cleaner power nozzle adapted to be mounted on the end of a cleaning wand has a rotating cleaning brush driven by an electric motor connected by a belt to the center of the brush to provide uniform forces on the brush end support bearings. A three-section plate forms the nozzle housing closure and base. One section of the plate covers the motor compartment and a second section of the plate covers the brush adjustment means. Each of these plates is held in place by a simple removable screw. A third section of the plate covers the suction duct and brush suction chamber and is removably mounted on the housing by spring biased clips to provide easy access to the suction duct and chamber. A pair of front nozzle wheels are rotatably journaled on the ends of a lever which is pivotally mounted on the housing. A threaded manually operated screw is operatively engaged with the lever to obtain numerous adjustment positions of the brush and suction chamber with respect to a surface being cleaned. The nozzle is connected to the wand of a suction cleaner by a swivel connection. The swivel connection has a pair of trunnions which are pivotally mounted in a pair of sockets by low friction bushings. A fabric sealing liner is placed between the swivel connection and the nozzle housing to decrease the sliding friction and to improve the air seal therebetween.

19 Claims, 14 Drawing Figures

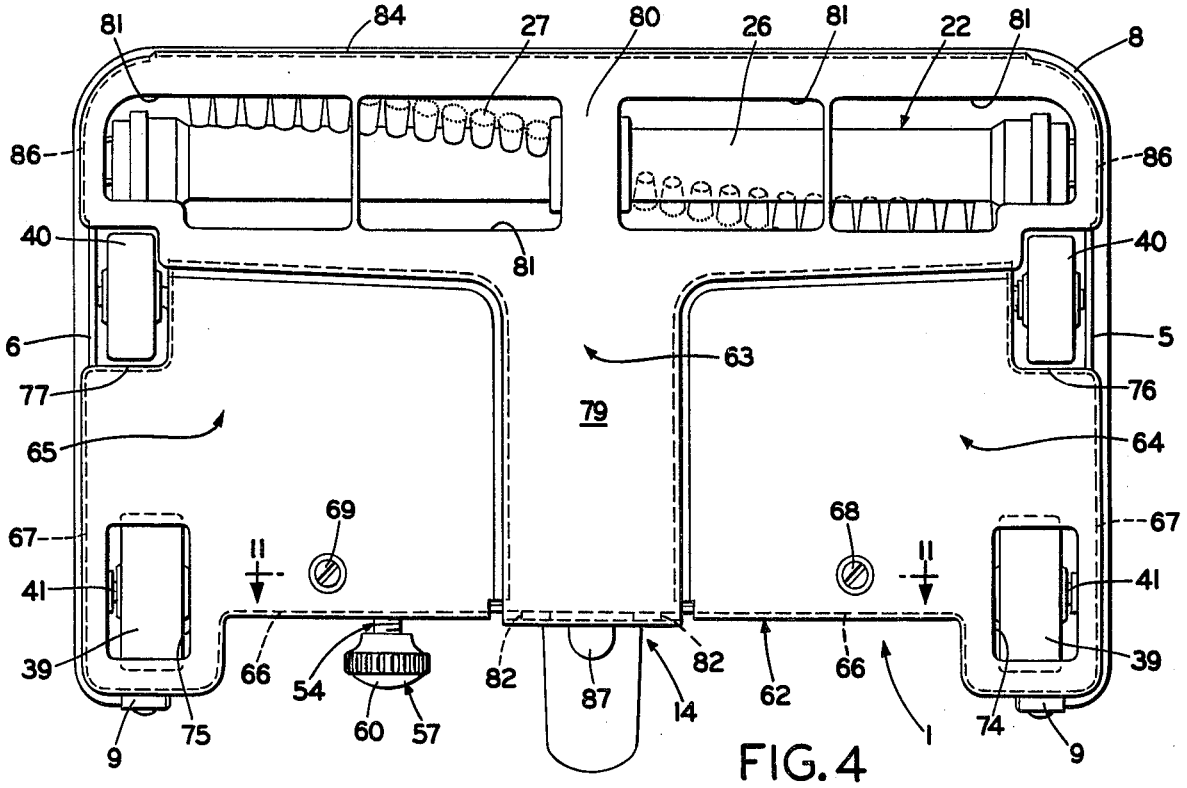
FIG. 4
FIG. 5
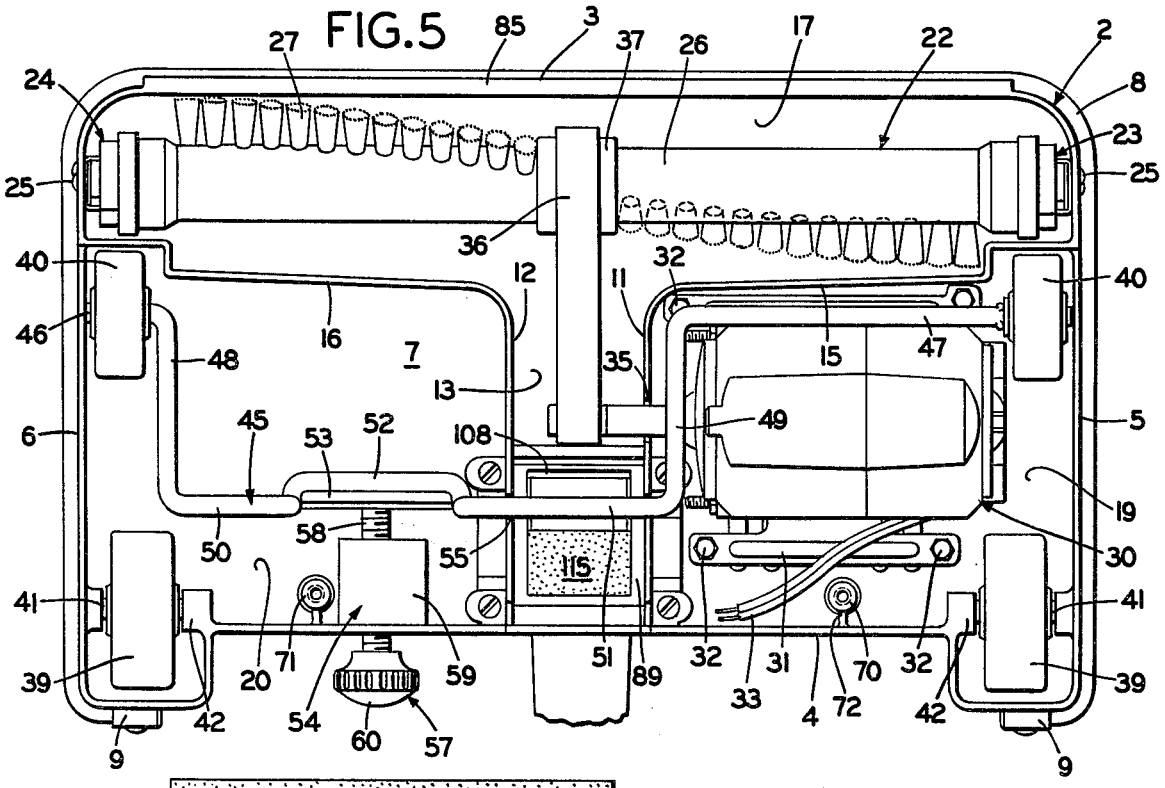
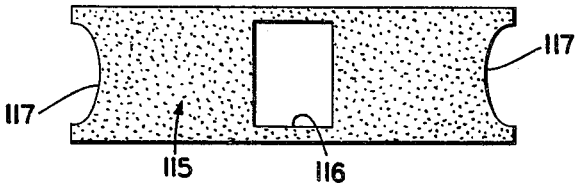
FIG. 14

SUCTION CLEANER POWER NOZZLE CONSTRUCTION

BACKGROUND OF THE INVENTION

1. Field of the Invention

The invention relates to suction cleaners and particularly to an improved power nozzle construction normally used at the end of a wand of a suction cleaner. More particularly, the invention relates to the construction of such a power nozzle having an improved swivel connection between the wand and nozzle housing, a three-section base cover plate enclosing the bottom of the nozzle housing, a central engagement of the drive belt with the rotary brush, and an improved adjustment means for raising and lowering the front of the nozzle housing with respect to a surface being cleaned.

2. Description of the Prior Art

A usual power nozzle of a suction cleaner is removably mounted on the end of a wand which in turn is connected by a flexible hose with a tank cleaner or a canister-type cleaner. The nozzle has an elongated main suction chamber and inlet opening extending crosswise of the direction of movement of the nozzle across the floor. A brush is mounted in the suction chamber and is driven by an electric motor mounted within the nozzle housing.

Most prior nozzle housings have a one-piece removable base plate which encloses the bottom of the nozzle housing. Removal of this base plate permits access to the brush, motor and other nozzle components for maintenance and for replacement of the drive belt which connects the motor to the brush. Access also is desirable to permit removal of large debris or objects which collect or lodge in the brush chamber or main suction duct. This base plate usually is mounted on the housing by a plurality of screws or bolts which must be manually removed to provide the desired access into the housing interior. The removal of these attachment screws is both time consuming and troublesome to many housekeepers, especially when access is only desired to the suction chamber, rotatary brush or suction duct for removal of lodged debris or belt replacement.

Many known power nozzles are provided with means for adjusting the height of the suction chamber openings and power driven brush with respect to a surface being cleaned to compensate for the various types of floors and carpets. Most of these known nozzle adjustment means only provide several positive adjustment heights, such as shown in U.S. Pat. No. 3,818,540. Housekeepers at times desire an adjustment height between the allowable adjustment positions of prior nozzles due to various peculiarities and characteristics of a surface being cleaned which is not possible to obtain with known nozzle adjustment means.

Most power nozzles are connected to a suction cleaner wand by a pivotally or swivelly mounted connection which is formed as a part of the nozzle housing. The swivel connection usually has a short section of tube extending outwardly from the housing for telescopic engagement with the lower end of the suction cleaner wand. Examples of known swivel connectors are shown in U.S. Pat. Nos. 2,642,617, 3,184,775, 3,391,418 and 3,614,705. Although the connectors of these patents and others used in various suction cleaners usually accomplished their intended purpose, it is desirable to reduce the sliding friction between the swivel member and its associated housing socket to facilitate the cleaning operation while maintaining a generally air-tight seal at this location to provide maximum suction at the cleaning nozzle.

Most power driven nozzles have an electric motor mounted within the nozzle housing which drives a rotary brush through a short, continuous flexible drive belt. The belt usually engages one end of the brush due to the particular mounting arrangement of the motor, suction duct, and other components within the nozzle housing, although center belt drives have been known. This engagement of the drive belt with an end of the brush may cause unbalanced forces to be exerted on the bearings or mounting bushings at the brush ends.

Thus, the need exists in the suction cleaner field for an improved power driven nozzle construction having a nozzle housing base plate formed of a plurality of plate sections, each of which can be removed easily to provide access to the various sections of the interior, and particularly to provide easy access to the suction duct and brush chamber; which nozzle has a swivel connector that reduces the sliding friction between the connector and nozzle housing while maintaining an air-tight seal; which nozzle includes means for obtaining numerous adjustment positions of the nozzle suction opening with respect to a surface being cleaned; and in which the drive belt engages the midpoint of the rotary brush. No suction cleaner power nozzle construction of which we are aware has a construction combining all of such features for achieving these results.

SUMMARY OF THE INVENTION

Objectives of the invention include providing an improved suction cleaner power nozzle construction for mounting on the end of a wand of a usual suction cleaner, in which the nozzle has a three-piece base plate closure for the bottom of the nozzle housing with two of the plate sections each being mounted on the housing by a single screw which is easily removable to provide selective access to the rotary brush drive motor and the brush adjustment means, and in which the third base plate section is removably mounted on the housing by a pair of spring-biased clips to provide access to the suction duct and rotary brush for cleaning thereof and for replacing the rotary brush drive belt without removing any screws or other fastening means; providing such an improved power nozzle construction in which the shaft of the brush drive motor extends into the suction duct, whereby the drive belt is operatively connected to the center of the brush to provide a uniformity of forces acting on the brush support bearings at the ends of the brush; providing such an improved power nozzle construction in which the front wheels of the nozzle housing are rotatably mounted on the ends of a pivotally mounted lever for adjusting the height of the nozzle opening and brush with respect to a surface being cleaned, and in which adjustable screw means is engageable with the lever to provide a considerable number of adjustment heights of the nozzle opening and brush; providing such a power nozzle construction in which the nozzle is connected to the suction cleaner wand by an improved swivel connection at the outlet end of the nozzle housing, which connection has a pair of trunnions mounted in low friction bushings with a fabric sealing liner being located between the pivotal connection and the nozzle housing socket to reduce the sliding friction and to increase the air seal therebetween; and providing such an improved power nozzle construction which eliminates difficulties heretofore encountered with prior power-driven cleaning nozzles, which achieves the stated objectives simply and effectively, and which solves problems and satisfies needs existing in the art.

These objectives and advantages are obtained by the improved suction cleaner power nozzle construction, the general nature of which may be stated as including in combination; front, rear, side and top walls forming a generally rectangular-shaped nozzle housing; partition means mounted within the housing, said partition means forming an elongated suction chamber extending transversely across the front of the housing, a centrally extending suction duct communicating with said suction chamber, and first and second compartments located on opposite sides of the suction duct and rearwardly of the suction chamber; brush means rotatably mounted in the suction chamber; electric motor means mounted in the first compartment and operatively drive belt connected to the center of the brush means for rotating said brush means; lever means pivotally mounted within the nozzle housing, the lever means having a pair of wheels rotatably mounted on the ends of the lever means for supporting the nozzle housing for movement across a surface to be cleaned; screw means operatively engageable with the lever means for adjusting the wheels with respect to the nozzle housing; plate closure means removably mounted on the bottom of the nozzle housing, said plate means having three separate plates with two of said plates covering the first and second nozzle housing compartments respectively, and the third plate covering the suction duct; and swivel connection means mounted on the rear of the nozzle housing for connecting the nozzle housing to a wand of a suction cleaner, the swivel connection means having a fabric liner to decrease the sliding friction and to provide an air seal between the swivel connection means and the nozzle housing.

BRIEF DESCRIPTION OF THE DRAWINGS

A preferred embodiment of the invention—illustrative of the best mode in which applicants have contemplated applying the principles—is set forth in the drawings and is particularly and distinctly pointed out and set forth in the appended claims.

FIG. 4 is a bottom plan view of the power nozzle construction shown in FIG. 3;

FIG. 5 is a view similar to FIG. 4 with the improved three-piece base plate removed;

FIG. 14 is a plan view of the fabric liner which is shown mounted between the swivel connector and pivot socket in FIGS. 1, 3, 5, 6 and 8.

Similar numerals refer to similar parts throughout the drawings.

DESCRIPTION OF THE PREFERRED EMBODIMENT

Figure 1:
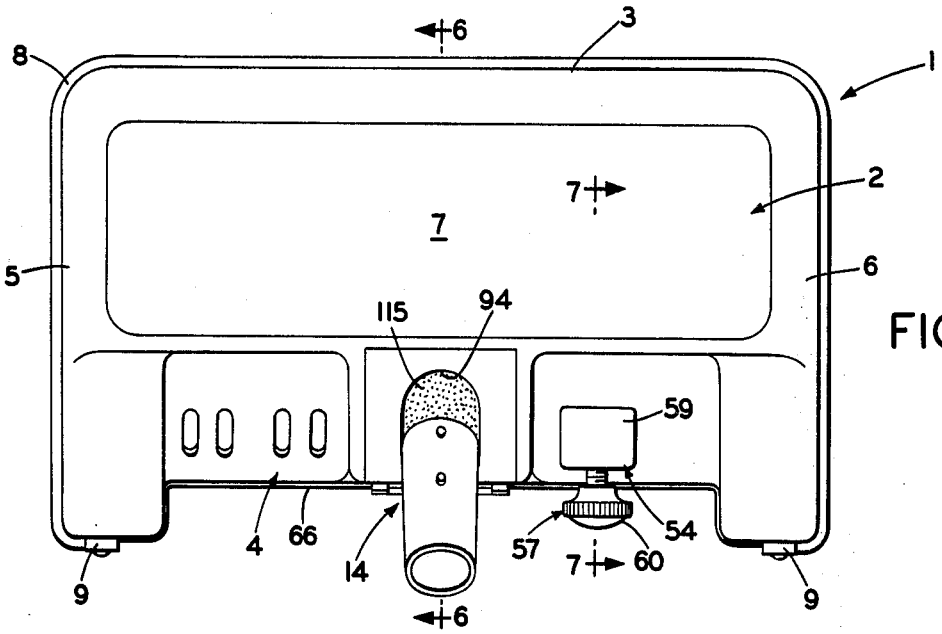
FIG. 1 is a top plan view of the improved power nozzle construction.
Figure 2:
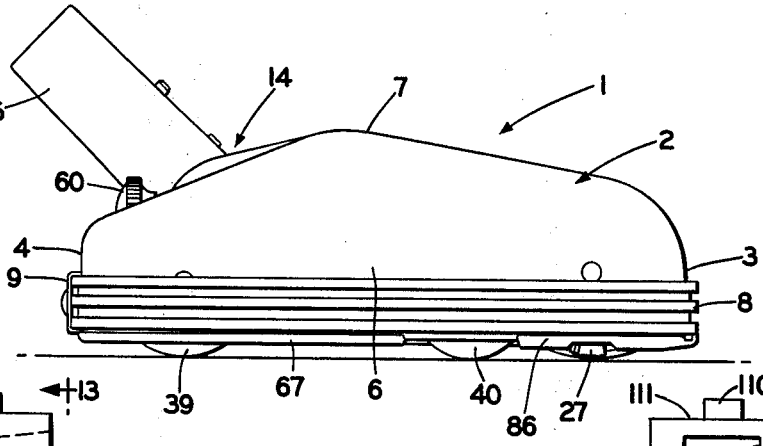
FIG. 2 is an enlarged right-hand side elevational view of the power nozzle construction shown in FIG. 1.

The improved power nozzle construction is indicated generally at 1, and is shown particularly in FIGS. 1–5, Nozzle 1 includes a housing 2 formed by spaced parallel front and rear walls 3 adn 4, side walls 5 and 6, and a generally dome-shaped top wall 7. A rubber strip 8 is mounted on housing 2 by a pair of screw-fastened clips 9. Strip 8 extends about the lower portions of side walls 5 and 6 and front wall 3 to protect walls, baseboards, furniture, etc. from being marred or scratched during cleaning operations.

A pair of spaced parallel internal housing walls 11 and 12 (FIG. 5) is formed integrally with and extend downwardly from top wall 17 within housing 2. Walls 11 and 12 form a suction duct 13 which extends longitudinally centrally within housing 2 and which communicates with an improved swivel connector means, indicated generally at 14. A second pair of walls 15 and 16 is formed integrally with the forward ends of duct walls 11 and 12, respectively. Walls 15 and 16 flair outwardly from walls 11 and 12 in a generally parallel relationship with front wall 3 to form an elongated suction chamber 17 (FIG. 5) which extends transversely across the front of housing 2. Duct walls 11 and 12, together with portions of housing side walls 5 and 6, suction chamber walls 15 and 16, and rear wall 4 form compartments 19 and 20 which are located rearwardly of suction chamber 17 and on opposite sides of suction duct 13.

A usual brush indicated generally at 22, is rotatably mounted within suction chamber 17 by a pair of bearing and clip mounting assemblies 23 and 24. Assemblies 23 and 24 may have a construction similar to that of U.S. Pat. No. 3,846,865, and are mounted on side walls 5 and 6 by screws 25. Brush 22 includes a shaft 26 having a plurality of bristles 27 extending outwardly therefrom.

An electric motor 30 (FIG. 5) is mounted in compartment 19 by a mounting bracket 31 which is attached by a plurality of bolts 32 to housing top wall 7. An electric cord 33 extends from motor 30 and is adapted to be connected to a source of electric power at a terminal block (not shown) which preferably is mounted on housing rear wall 4.

Motor drive shaft 34 extends through an opening 35 formed in suction duct wall 11. An endless brush drive belt 36 engages the extended end of shaft 34 and a raised pulley surface 37 formed on brush shaft 26 for rotatably driving nozzle brush 22. Belt 36 extends forwardly through the center of suction duct 13 and is operatively engaged with brush 22 at the center thereof to provide a uniformity of forces acting on bearing assemblies 23 and 24 at the brush ends.

Nozzle 1 is movably supported for rolling movement over a floor or the like on a pair of rear wheels 39 and a pair of front wheels 40. Rear wheels 39 are rotatably mounted on shafts 41 which extend between side walls 5 and 6 and a pair of projection blocks 42 which are formed on rear wall 4.

Figure 7:
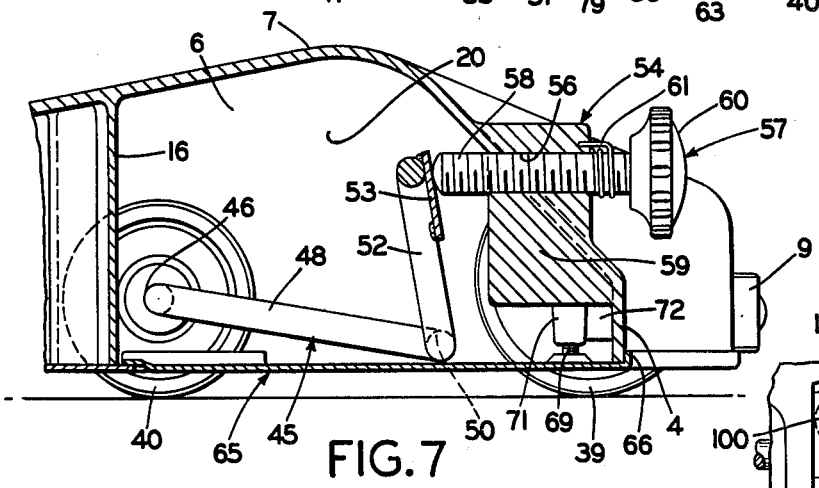
FIG. 7 is an enlarged fragmentary sectional view taken on line 7—7, FIG. 1.

Front wheels 40 are mounted on the ends of an irregularly shaped lever indicated generally at 45, which is pivotally mounted on nozzle 1 within housing 2. Lever 45 is somewhat similar to the lever mechanism shown in U.S. Pat. No. 3,818,540 and includes laterally extending end sections 46 and 47 on which front wheels 40 are rotatably journaled. Lever 45 has a pair of parallel longitudinally extending lever sections 48 and 49 extending from and normal to end sections 46 and 47. Lever sections 48 and 49, in turn, are integrally connected with lever sections 50 and 51, which lie in a common horizontal plane (FIGS. 5 and 7). Lever sections 50 and 51 are connected by a U-shaped lever section 52. A camming plate 53 is welded on U-shaped section 52 and is engaged by an improved nozzle adjusting mechanism, indicated generally at 54. Lever 45 is pivotally mounted on nozzle housing 2 by a center lever section 51 which lies loosely within a pair of U-shaped slots 55 formed in duct walls 11 and 12 (FIG. 5).

In accordance with one of the combined aspects or features of the invention, lever 45 is pivoted by improved adjusting mechanism 54 to a continuous number of adjusted positions by an adjusting screw 57. Screw 57 has a threaded shaft 58 which extends through a threaded opening 56 formed in a block 59 which is mounted on a portion of rear housing wall 4. A knob 60 is mounted on the outer end of shaft 58 for rotating the shaft with the inner shaft end being in engagement with camming plate 53. Rotation of knob 60 will advance or retract shaft 58 with respect to block 59, pivotally swinging lever 45 within its mounting slots 55 to raise or lower front wheels 40 with respect to nozzle housing 2. A tensioning spring 61 (FIG. 7) is mounted on threaded shaft 58 and is operatively engaged with block 59 to maintain adjusting screw 57 in its adjusted positions.

Figure 11:
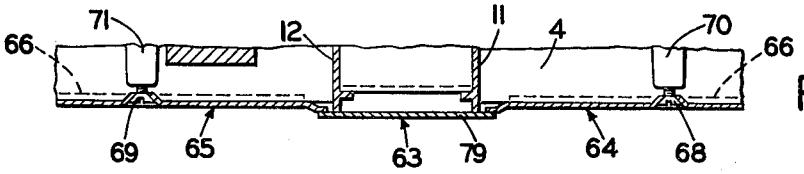
FIG. 11 is a fragmentary sectional view taken on line 11—11, FIG. 4.

In accordance with another important combined aspect or features of the invention, the bottom of nozzle housing 2 is enclosed by a three-piece base plate or closure, indicated generally at 62 and shown particularly in FIGS. 4 and 11. Plate 62 includes a generally T-shaped plate section 63 and a pair of compartment closure plate sections 64 and 65. Plate sections 63–65 preferably are stamped from thin sheet metal.

Figure 3:
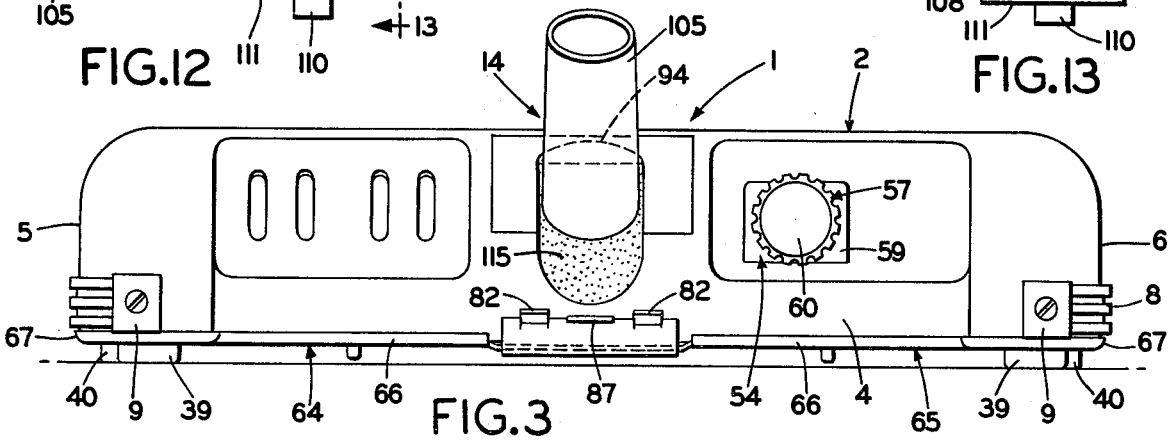
FIG. 3 is an enlarged rear elevational view of the power nozzle construction shown in FIG. 1.

Plate sections 64 and 65 enclose compartments 19 and 20, respectively, (FIG. 4). The outer edges of plate sections 64 and 65 terminate in upwardly projecting end and side flanges 66 and 67 which engage the bottom edges of rear and side walls 4 and 5, respectively, (FIGS. 3 and 7). One of the important features of the individual base plate sections 64 and 65 is that they are secured to the bottom of nozzle housing 2, each by a single screw, 68 and 69, respectively. A pair of verticle anchor posts 70 and 71 extend downwardly from the inner surface of top wall 7 into compartments 19 and 20, (FIGS. 5 and 11). Reinforcing ribs 72 connect posts 70 and 71 to rear wall 4. End and side flanges 66 and 67 hold base plates sections 64 and 65 on nozzle housing 2 together with screws 68 and 69 which extend through holes formed in each plate section and are threadably engaged in anchor posts 70 and 71. Rectangular shaped openings 74 and 75 are formed in plate sections 64 and 65 through which rear wheels 39 project. The outside forward corners of plate sections 64 and 65 are notched at 76 and 77 to provide openings for front wheels 40 (FIG. 4).

T-shaped plate section 63 includes a straight leg portion 79 which encloses suction duct 13 and a transversely extending portion 80 which encloses front suction chamber 17. A plurality of openings 81 are formed in transversely extending portion 80 through which brush bristles 27 project while rotating to contact a surface being cleaned.

Figure 6:
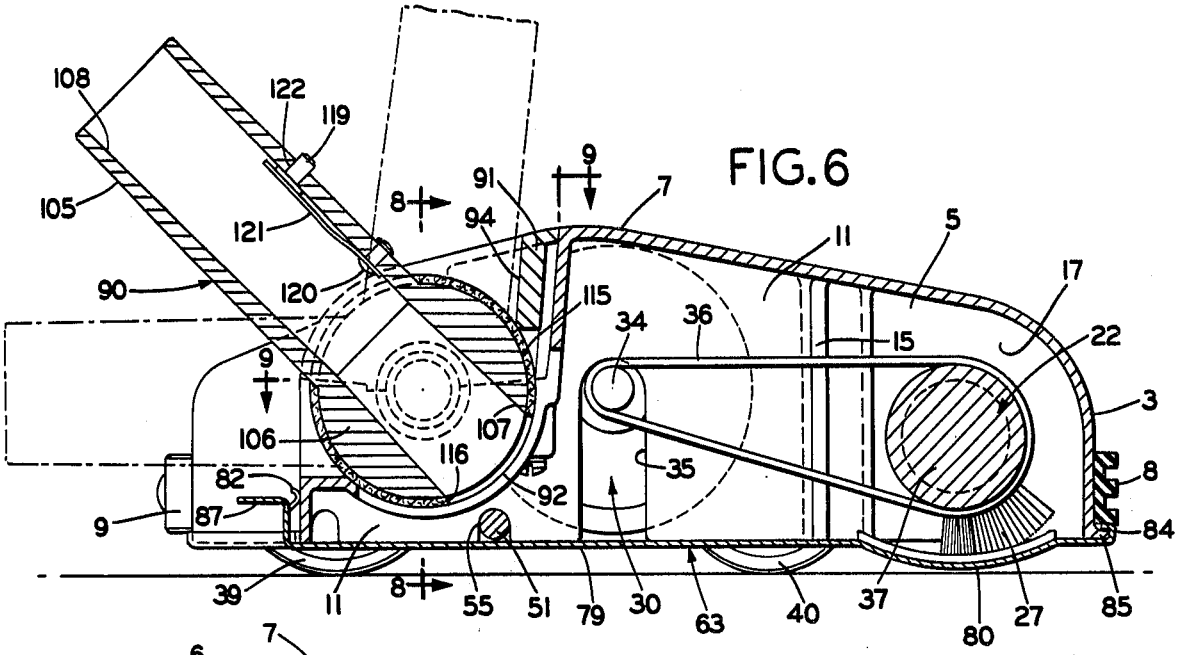
FIG. 6 is an enlarged sectional view taken on line 6—6, FIG. 1, with the swivel connector shown in dot-dash lines in various adjusted positions.
Figure 9:
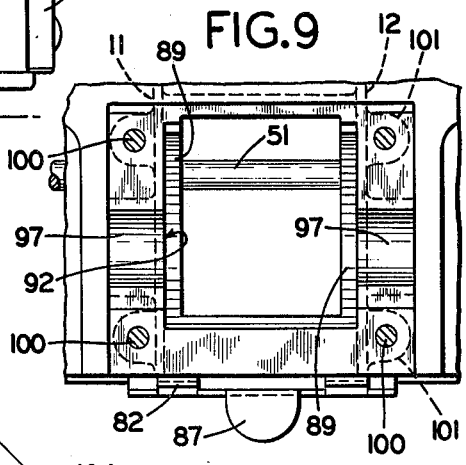
FIG. 9 is a fragmentary sectional view taken on line 9—9, FIG. 6 with the swivel connector removed.
Figure 10:
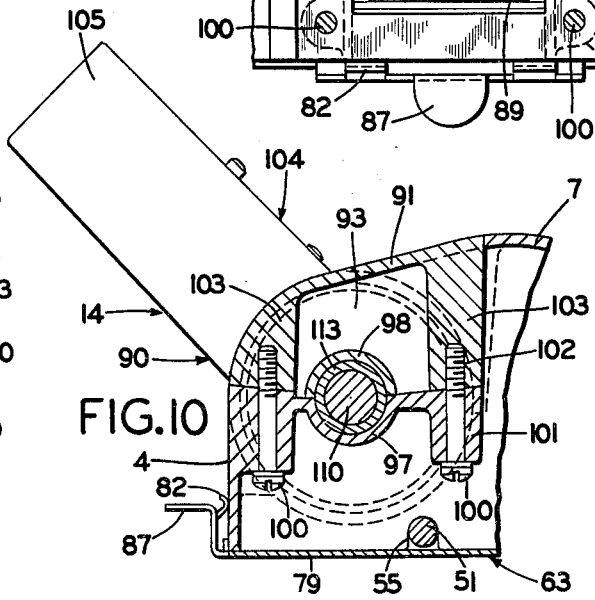
FIG. 10 is a fragmentary sectional view taken on line 10—10, FIG. 8.

One of the combined important features of T-shaped plate section 63 is its mounting on the bottom of nozzle housing 2 by a pair of spring-biased rear clips 82 (FIGS. 3, 9 and 10). The outer front edge of plate section 63 is formed with a reverse flange 84 (FIG. 6) which engages a projecting lip 85 which is formed on and extends along the bottom of housing front wall 3. The outer side edges of plate section 63 are formed with upstanding flanges 86 (FIG. 2) which extend over and along the bottom edges of the front portions of housing side walls 5 and 6. A finger tab 87 (FIGS. 9 and 10) projects outwardly from between spring clips 82 for installing and removing plate section 63 on and from its attached position on the bottom of housing 2.

Straight leg portion 79 of plate section 63 retains lever 45 in its pivotal mounting location within U-shaped slots 55 of duct walls 11 and 12 (FIG. 10). The side edges of straight leg portion 79 and the rear edges of transversely extending portion 80 of T-shaped plate 63 overlap the associated edges of plate sections 64 and 65 as shown in FIGS. 4 and 11 to form the nozzle bottom closure plate. Plate section 63 abuts the bottom edges of duct walls 11 and 12 and suction chamber walls 15 and 16 to form a generally air-tight seal for suction duct 13 and suction chamber 17, except for the brush openings 81 formed therein. A sealing gasket (not shown) may extend along the outer edges of T-shaped plate section 63 to improve the air seal with the bottom edges of compartment forming walls 11, 12, 15 and 16 and nozzle housing walls 3, 5 and 6.

Figure 8:
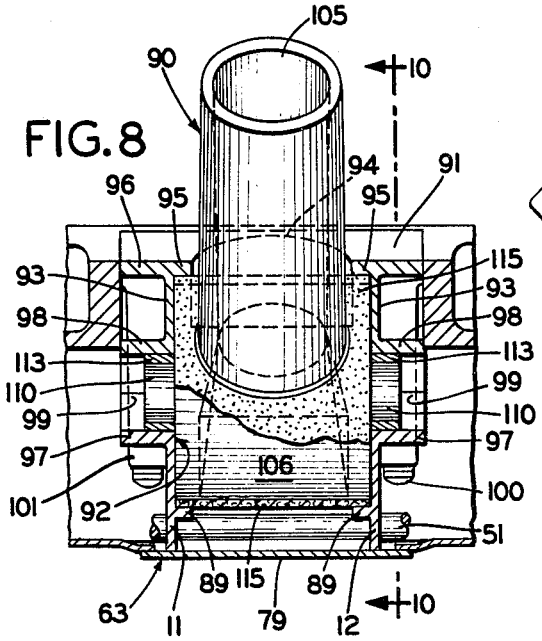
FIG. 8 is a fragmentary sectional view taken on line 8—8, FIG. 6.

Another important feature of improved nozzle 1 is swivel connector means 14 which operatively connects the outlet end of suction duct 13 with the wand of a suction cleaner. A pair of curved ribs 89 (FIGS. 5, 8 and 9) are formed integrally with duct walls 11 and 12 and project inwardly into duct 13 to form the lower half of a socket 92 for pivotally mounting a swivel connector 90 therein.

A socket cover 91 having a curved top wall 96 is removably mounted on nozzle housing 2 at the junction of top wall 7 and rear wall 4. Cover 91 has a pair of spaced inner walls 93 (FIG. 8) which are vertically aligned with and spaced above the rear portions of duct walls 11 and 12 to form the upper half of pivot socket 92. A generally U-shaped opening 94 is formed in cover 91 with inner walls 93 being spaced inwardly from the edges of opening 94 to form a pair of spaced curved ribs 95 which follow the curvature of cover top wall 96. Upper ribs 95 and lower ribs 89 form a pair of spaced annular retaining members for containing and pivotally mounting swivel connector 90 therein.

A pair of horizontally aligned semi-circular concave projections 97 (FIG. 8) are formed on duct walls 11 and 12 and project outwardly therefrom forming the lower half of a pair of hollow cylindrical bearing sleeves 99. A similar pair of semi-circular convex projections 98 are formed on the bottom of cover walls 93 to form the upper half of cylindrical bearing sleeves 99. Cover 91 is removably mounted on housing 2 by four bolts 100 (FIG. 10) which extend upwardly through mounting posts 101 formed integrally on the outer surface of duct walls 11 and 12 (FIG. 9). Bolts 100 are engaged in vertically aligned threaded holes 102 formed in corresponding mounting posts 103 provided on and extending downwardly from cover 91.

Figure 12:
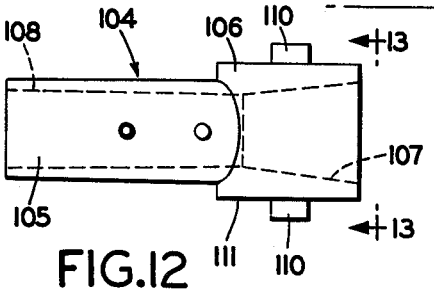
FIG. 12 is a top plan view of the swivel connector.
Figure 13:
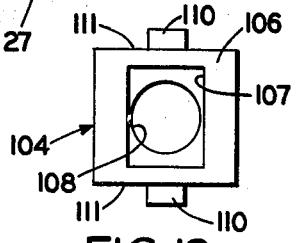
FIG. 13 is an end view of the swivel connector looking in the direction of arrows 13—13, FIG. 12.

The improved swivel connector is indicated generally at 104 (FIGS. 12 and 13), and includes a tubular attachment sleeve 105 and a transversely extending cylindrical pivot sleeve 106 mounted on the lower end thereof. A rectangular opening 107 is formed in the forward end of pivot sleeve 106 and is aligned with a cylindrical bore 108 of tubular sleeve 105 for communication with suction duct 13.

One of the improved features of swivel connector 104 is the use of a pair of horizontally aligned trunnions 110 which are mounted on the side walls 111 of pivot sleeve 106. Trunnions 110 are received within bearing sleeves 99 for rotatably mounting swivel connector 104 within socket 102. Preferably, a pair of bushings 113, formed of Nylon or similar synthetic friction-reducing material, are telescopically mounted on trunnions 110. Bushings 113 can either be stationary with respect to trunnions 110 or rotate with the trunnions to provide a low friction bearing for the pivotal movement of swivel connector 104.

A further combined aspect or feature of improved nozzle 1 is the mounting of a fabric liner 115 between pivot sleeve 106 of connector 104 and the walls of pivot socket 92. Liner 115 is an elongated strip of material (FIG. 14) having a rectangular configuration with a central opening 116 and a pair of generally U-shaped end cutouts 117 formed therein. Liner 115, preferably is formed of a matted or compressed fiber fabric such as felt formed of wool or cotton fibers, or other synthetic fiberous material which provides a smooth sliding engagement with the metal walls of pivot socket 92.

Liner 115 is curved about pivot sleeve 106 with liner opening 116 aligning with sleeve opening 107. Cutouts 117 and adjacent to each other and form a elliptical-shaped opening generally complementary to the diameter of tubular attachment sleeve 105 which projects through aligned cutouts 117.

A spring biased pin 119 (FIG. 6) is mounted on tubular sleeve 105 by a rivet 120. Pin 119 is mounted on the end of a strip of spring steel 121 within sleeve bore 108 and projects through a hole 122 formed in sleeve 105 for engagement in a complementary shaped hole formed in the end of a suction cleaner wand (not shown).

The improved nozzle construction 1 combines a number of interrelated aspects, features, structures, and advantages not present in prior power driven suction cleaner nozzles of which we are aware. The three-piece nozzle housing base plate 62 permits easy access to suction duct 13 and suction chamber 17 to remove lodged debris or to replace center-brush drive belt 36 by a simple and rapid manipulation of finger tab 87 of spring clips 82. Spring clips 82 enable T-shaped plate section 63 to be removed without any additional manipulation being required. Likewise, removal of a single screw 68 or 69 permits access into compartments 19 and 20 after removal of T-shaped plate section 63.

The center-brush drive belt 36 for brush 22 eliminates unequal forces from being exerted on the end mounting bearings or sleeves. Likewise, nozzle adjusting means 54 enables numerous adjustment positions to be obtained for nozzle opening 81 with respect to a surface being cleaned by a simple manual rotation of adjusting knob 60.

Further elements combined in the improved power nozzle include the swivel connector means 14 having the fabric liner 115 which is mounted on cylindrical pivot sleeve 106 to provide reduced sliding friction with pivot socket 92 formed in housing 2. Liner 115, also increases the air seal at the outlet end of suction duct 12 at the swivel connector location.

Accordingly, the combined components characterizing the suction cleaner power nozzle construction of the invention incorporate the new and advantageous features described above, overcome the prior art difficulties indicated, solve problems, obtain new results and satisfy needs existing in the art.

In the foregoing description, certain terms have been used for brevity, clearness and understanding but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details of the construction shown or described.

Having now described the features, discoveries and principles of the invention, the manner in which the improved suction cleaner power nozzle construction is constructed, assembled and operated, the characteristics and combined features of the new construction, and the advantageous, new and useful results obtained; the new and useful structures, devices, elements, arrangements, parts, and combinations are set forth in the appended claims.

We claim:

1. In suction cleaner power nozzle construction the combination of:

(a) front, rear, side and top walls forming a generally rectangular nozzle housing;

(b) partition means in the housing forming an elongated suction chamber extending transversely across the front of the housing and forming a centrally extending suction duct communicating with said suction chamber, and also forming first and second compartments located on opposite sides of the suction duct and rearwardly of the suction chamber;

(c) rotatable brush means journaled in the suction chamber;

(d) motor drive means in the first compartment operatively connected with the brush means for rotating said brush means, said motor drive means including a shaft extending through the partition means and into the suction duct and belt means engaging the shaft in said suction duct and engaging the midpoint of the brush means for operatively driving said brush means;

(e) lever means pivotally mounted in the housing provided with a pair of wheels rotatably mounted on the ends of the lever means supporting the nozzle housing for movement across a surface to be cleaned;

(f) adjusting means engaged with the lever means operable to adjust the wheel location with respect to the nozzle housing;

(g) closure plate means spaced from the top housing wall and removably engaged with the front, rear and side housing walls, said closure plate means comprising three separate plates, two of which form closures for the first and second housing compartments, and the third of which forms a closure for the suction duct; and (h) swivel connector means engaged with the housing for connecting said housing with a suction cleaner wand, the swivel connector means being provided with a fabric liner to decrease the sliding friction and to improve the air seal between relatively movable parts of the swivel connector means and the nozzle housing.

2. The construction defined in claim 1 in which the housing has a socket formed therein, and in which the swivel connector means has a horizontal cylindrical pivot sleeve rotatably engaged in said socket; in which the housing has a pair of spaced, horizontally aligned bearing sleeves communicating with the socket; in which the swivel connector means has a trunnion at each end of the pivot sleeve; and in which the trunnions are telescopically received in the bearing sleeves.

3. The construction defined in claim 2 in which the fabric liner is formed of a felt material; and in which the liner is mounted on and extends about the cylindrical pivot sleeve.

4. The construction defined in claim 2 in which a friction reducing bushing is mounted on each of the pivot sleeve trunnions; and in which the bushings are telescopically received within the bearing sleeves.

5. The construction defined in claim 2 in which the fabric liner has an elongated rectangular configuration; and in which an opening is formed in the center of the strip and a U-shaped cutout is formed in each end of said strip.

6. The construction defined in claim 1 in which the third closure plate is generally T-shaped having a straight leg portion and an end portion extending transversely to said straight leg portion; in which the straight leg portion covers the suction duct and the transverse end portion covers the suction chamber; and in which openings are formed in the transverse end portion through which the brush means extends for cleaning a surface.

7. The construction defined in claim 1 in which spring biased clip means is mounted on the third closure plate; and in which the clip means releaseably engages the rear wall of the housing to permit removal of said third plate from the housing.

8. The construction defined in claim 1 in which the first and second compartments are provided with first and second posts, respectively; and in which first and second screws engage the first and second posts, respectively, to removably mount said first and second plates on the housing.

9. The construction defined in claim 1 in which the wheel adjusting means includes a screw threadably mounted on and extending through the housing into the second compartment; and in which the adjustment screw has an inner end engaged with the lever means, and knob means mounted on the outer end for manually adjusting said screw.

10. In suction cleaner power nozzle construction having a generally rectangular nozzle housing with an open bottom; partition means in the housing forming an elongated suction chamber extending transversely across the front of the housing and forming a centrally extending suction duct communicating with said suction chamber, and also forming first and second compartments located on opposite sides of the suction duct and rearwardly of the suction chamber; closure plate means removably engaged with the housing for closing the housing open bottom, said plate means comprising three separate plates, two of which form closures for the first and second housing compartments, and the third of which forms a closure for the suction duct; and spring-biased clip means mounted on the third closure plate and releasably engaging the housing to permit removal of said third plate from the housing.

11. The construction defined in claim 10 in which the third closure plate is generally T-shaped having a straight leg portion and an end portion extending transversely to said straight leg portion; in which the straight leg portion covers the suction duct and the transverse end portion covers the suction chamber; and in which openings are formed in the transverse end portion.

12. The construction defined in claim 10 in which the first and second compartments are provided with first and second posts, respectively; and in which first and second screws engage the first and second posts, respectively, to removably mount said first and second plates on the housing.

13. The construction defined in claim 10 in which the housing is formed with a socket; in which the housing further includes swivel connector means for connecting the housing with a suction cleaner wand; in which the swivel connector means includes a horizontal cylindrical pivot sleeve rotatably mounted in the socket; in which the housing has a pair of spaced, horizontally aligned bearing sleeves communicating with the socket; in which the swivel connector means has a trunion at each end of the pivot sleeve; and in which the trunions are telescopically received in the bearing sleeves.

14. The construction defined in claim 13 in which a fabric liner formed of a felt material is mounted on and extends about the cylindrical pivot sleeve.

15. The construction defined in claim 14 in which the fabric liner has an elongated rectangular configuration; and in which an opening is formed in the center of the strip and a U-shaped cutout is formed in each end of the strip.

16. The construction defined in claim 13 in which a friction-reducing bushing is mounted on each of the pivot sleeve trunions; and in which the bushings are telescopically received within the bearing sleeves.

17. The construction defined in claim 10 in which lever means is pivotally mounted in the housing and is provided with a pair of wheels rotatably mounted on the ends of the lever means for supporting the nozzle housing for movement across a surface to be cleaned; in which adjusting means is engaged with the lever means operable to adjust the wheel location with respect to the nozzle housing; in which the wheel adjusting means includes a screw threadably mounted on and extending through the housing rear wall into the second compartment; and in which the adjustment screw has an inner end engaged with the lever means, and knob means mounted on the outer end for manually adjusting said screw.

18. The construction defined in claim 10 in which a rotatable brush is journaled in the suction chamber; in which motor drive means is mounted in the first compartment and operatively connected with the brush for rotating said brush; in which the motor drive means includes a shaft which extends through the partition means and into the suction duct; and in which a belt engages the shaft in the suction duct and engages the midpoint of the brush for operatively driving said brush.

19. In suction cleaner power nozzle construction the combination of:

(a) front, rear, side and top walls forming a generally rectangular nozzle housing;

(b) partition means in the housing forming an elongated suction chamber extending transversely across the front of the housing and forming a centrally extending suction duct communicating with said suction chamber, and also forming first and second compartments located on opposite sides of the suction duct and rearwardly of the suction chamber;

(c) rotatable brush means journaled in the suction chamber;

(d) motor drive means in the first compartment operatively connected with the brush means for rotating said brush means;

(e) lever means pivotally mounted in the housing provided with a pair of wheels rotatably mounted on the ends of the lever means supporting the nozzle housing for movement across a surface to be cleaned;

(f) adjusting means engaged with the lever means operable to adjust the wheel location with respect to the nozzle housing;

(g) closure plate means spaced from the top housing wall and removably engaged with the front, rear and side housing walls, said closure plate means comprising three separate plates, two of which form closures for the first and second housing compartments, and the third of which forms a closure for the suction duct;

(h) spring biased clip means mounted on the third closure plate and releasably engaging the rear wall of the housing to permit removal of said third plate from the housing; and (i) swivel connector means engaged with the housing for connecting said housing with a suction cleaner wand, the swivel connector means being provided with a fabric liner to decrease the sliding friction and to improve the air seal between relatively movable parts of the swivel connector means and the nozzle housing.

* * * * *